US006729141B2

(12) United States Patent
Ingram

(10) Patent No.: US 6,729,141 B2
(45) Date of Patent: May 4, 2004

(54) MICROTURBINE WITH AUXILIARY AIR TUBES FOR NOX EMISSION REDUCTION

(75) Inventor: Joe Britt Ingram, Palm Beach Gardens, FL (US)

(73) Assignee: Elliot Energy Systems, Inc., Stuart, FL (US)

( * ) Notice: Subject to any disclaimer, the term of this patent is extended or adjusted under 35 U.S.C. 154(b) by 26 days.

(21) Appl. No.: 10/190,285

(22) Filed: Jul. 3, 2002

(65) Prior Publication Data

US 2004/0003599 A1 Jan. 8, 2004

(51) Int. Cl.[7] ..... F23R 3/04; F23R 3/50
(52) U.S. Cl. ..... 60/804; 60/752
(58) Field of Search ..... 60/732, 804, 752

(56) References Cited

U.S. PATENT DOCUMENTS 3,082,603 A * 3/1963 Hering et al. ..... 60/752
3,859,786 A * 1/1975 Azelborn et al. ..... 60/737
3,938,324 A * 2/1976 Hammond et al. ..... 60/737
4,265,615 A * 5/1981 Lohmann et al. ..... 60/748
5,025,622 A * 6/1991 Melconian ..... 60/755
5,158,445 A * 10/1992 Khinkis ..... 431/10
5,249,952 A * 10/1993 West et al. ..... 431/1
5,285,628 A * 2/1994 Korenberg ..... 60/752
5,303,543 A * 4/1994 Shah et al. ..... 60/804

* cited by examiner

*Primary Examiner*—Ted Kim
(74) *Attorney, Agent, or Firm*—Norman Friedland

(57) ABSTRACT

Air tubes are circumferentially spaced around the outer liner of an annular combustor for a microturbine engine in proximity to and downstream of a dam extending into the combustion chamber for reducing the emission of $NO_X$. The air tubes are dimensioned so that the length to passage diameter is such that a swirling motion of the air injected into the combustion zone is normal to the center line of the annular combustor.

6 Claims, 3 Drawing Sheets

MICROTURBINE WITH AUXILIARY AIR TUBES FOR NOX EMISSION REDUCTION

TECHNICAL FIELD

This invention relates to combustors for microturbine engines and particularly to a mechanism for reducing the emission of $NO_X$ therefrom.

BACKGROUND OF THE INVENTION

As is well known in the field of gas turbine engine technology, a considerable effort from engineers and scientist has been and is currently being aimed at the reduction and/or elimination of pollutants that are emitted into the atmosphere from these types of engines. It will be appreciated that exhaust gases produced by combusting hydrocarbon fuels has been targeted as being significantly responsible for such emissions. To this end, governmental agencies as well as industry have endeavored and continues to endeavor to make a concerted effort to correct this problem so as to "clean-up" the atmosphere. The pollution that is of concern for contributing to the degradation of the atmosphere are nitric oxide (NO), nitrogen dioxide ($NO_2$), unburned hydrocarbons, carbon monoxide (CO) and particulates. As will be appreciated from the description to follow this invention is primarily concerned with $NO_X$, (sometimes referred to as NO.sub.x) which is a combination of NO and $NO_2$.

It is likewise well known that emissions that are generated by combustion fall into two categories, namely, those due to high flame temperatures and those formed due to low flame temperatures. Hence, one of the parameters that is of concern in the design of the combustors, particularly for the high flame temperature environment, is the mixture between the fuel and the air so that during combustion of these elements burning will occur evenly throughout the mixture without introducing hot spots within the combustion chamber.

An example of a system for reducing the emission of $NO_X$ is taught in U.S. Pat. No. 6,314,717 granted to Teets et al on Nov. 13, 2001 entitled ELECTRICITY GENERATING SYSTEM HAVING AN ANNULAR COMBUSTOR commonly assigned to the assignee of this patent application, and incorporated by reference herein. In this system, a plurality of premix chambers are circumferentially spaced around the outer housing wall of the combustors and are positioned in close proximity to the fuel injectors and are angled to provide a predetermined direction of flow. In this arrangement, the inlet to the pre-mixers serve to direct a rich fuel/air mixture prior to combustion and adds additional air to create a combustible mixture which is burned in the primary zone of the combustors.

Also, it is well known, good mixing adjacent the fuel injector is another method for reducing the emission of $NO_X$. One type of system for providing a good mixture of the ingredients is by mixing of the fuel and air at the discharge end of the fuel injector. These types of systems are disclosed in U.S. Pat. No. 6,378,310 granted to Le Gal et al on Apr. 30, 2002 and entitled COMBUSTION CHAMBER OF A GAS WORKING ON LIQUID FUEL and U.S. Pat. No. 5,966,937 granted to Graves on Oct. 19, 1999 and entitled RADIAL INLET SWIRLER WITH TWISTED VANES FOR FUEL INJECTOR. In the combustors taught by Le Gal a series of orifices in the combustors are arranged so as to create separate fuel jets and the jets are arranged in the direction of the generatrices of a cone with given range of angles at the vertex thereof In the chamber of the combustors two types of pressurized air inlets are place in proximity to each other where one takes in air helically around the longitudinal axis of the chamber and the other takes the air in tangentially relative to the chamber so as to create around the fuel jets counter-rotating flows. In the patent to Graves this problem is addressed by including two swirlers concentrically mounted around the fuel injector where each swirler includes swirl vanes that are designed to provide the proper flow and swirl angle relative to the fuel being admitted into the combustion chamber.

An alternative method of reducing $NO_X$ is by providing a catalyst in the combustors and an example of this technology is disclosed in U.S. Pat. No. 6,307,278 granted to Nims et al on Oct. 23, 2001 and entitled MICROTURBINE POWER GENERATING SYSTEM and U.S. Pat. No. 6,125,625 granted to Lipinski et al on Oct. 3, 2000 entitled LOW NOX CONDITIONER SYSTEM FOR A MICROTURBINE POWER GENERATING SYSTEM. In these structures a well known catalytic combustion is strategically located in the combustion chamber of a microturbine for reducing the emission of pollutants.

It is quite apparent from the foregoing that there are many alternative methods for attempting to reduce pollutants and many of these designs are indigenous to the particular configuration of the gas turbine engine. Hence, the combustor designer has several options at his disposal for solving this problem and notwithstanding the fact that some of these teachings are employed, the end result is often not fully achieved. Often, the particular engine design will require particular design criteria in order to enhance the solution of the pollution reduction problem.

Hence, even with all of the parameters selected for the combustor with the aim of reducing pollution, one often finds that there is still an opportunity to reduce the emissions even further. This invention is particularly concerned with microturbines of the type that is disclosed in U.S. Pat. No. 6,314,717, supra and the types of microturbines manufactured by Elliott Energy Systems, Inc. and, particularly the types similar to and including Model Number TA-80. Hence, this invention is designed to reduce the $NO_X$ emissions from annular combustors that include a dam in the combustion chamber located between the primary and secondary combustion zones.

It is contemplated that providing critically dimensioned tubes for leading air in a discrete direction immediately downstream of the dam will reduce the NOX emissions emanating from this type of combustion chamber. This invention is characterized by the fact that this is a simple and economical way for enhancing the reduction of emission of $NO_X$ and improving the life of the combustor liner of these types of microturbines, without drastically changing the manufacturing, assembly and disassembly of the unit.

SUMMARY OF THE INVENTION

An object of this invention is to reduce the $NO_X$ emission from a combustion chamber of the type that includes a dam between the primary and secondary zones of a microturbine.

A feature of this invention is to judiciously locate and orient air tubes that direct air into the combustion zone downstream of the dam so that the air is imparted with a swirling motion in a plane transverse to the central axis of the combustion chamber.

Another feature of this invention is to provide air tubes that are critically dimensioned such that the air discharging from the air tubes will impart a swirling motion in a given direction.

Another feature of this invention is the provision of mechanism for reducing the emission of $NO_X$ from an annular combustor in a microturbine that is characterized as simple and inexpensive to manufacture, assemble, disassemble and maintain.

The foregoing and other features of the present invention will become more apparent from the following description and accompanying drawings.

Figure 1:
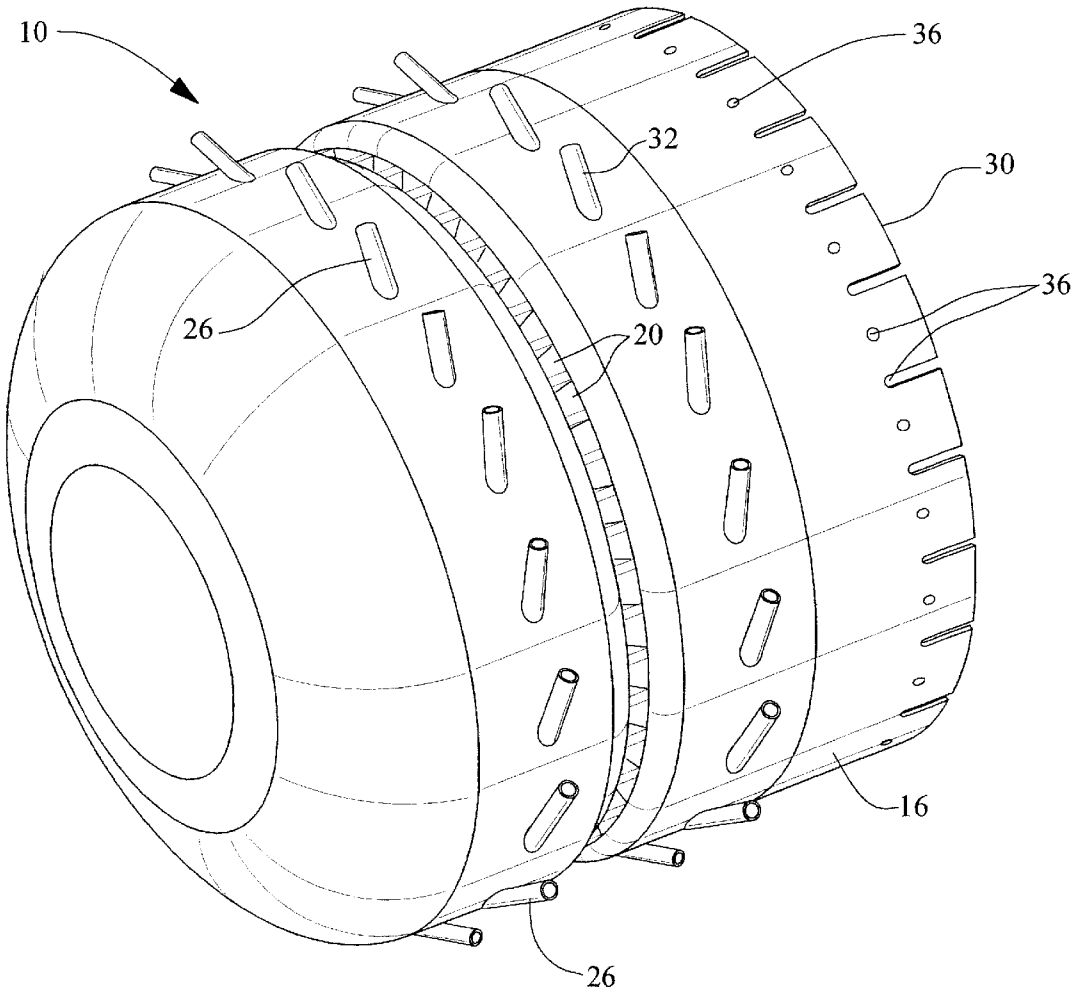
FIG. 1 is a view in perspective illustrating the combustion liner of the microturbine engine of this invention.
Figure 2:
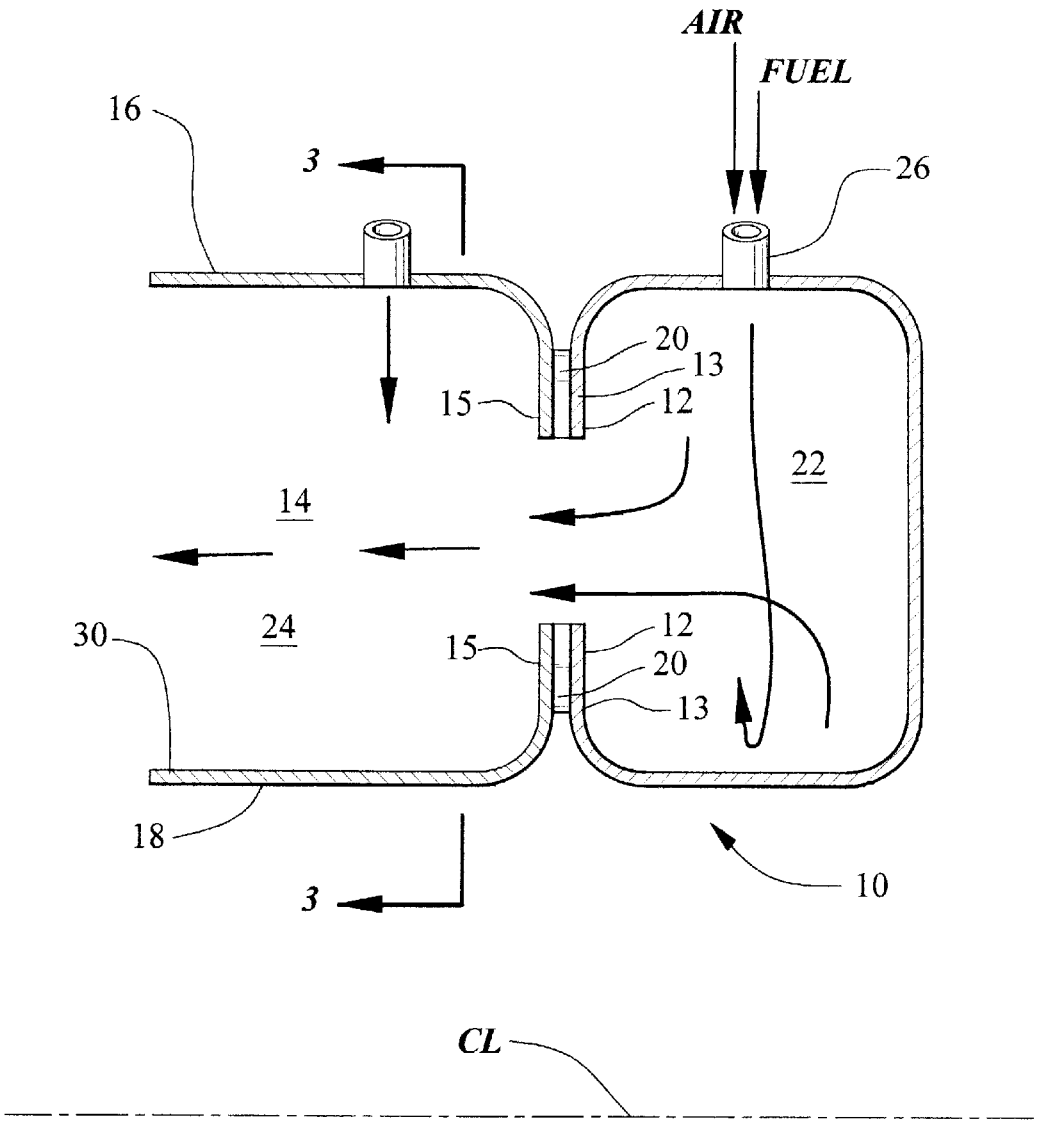
FIG. 2 is a partial sectional view of the outer half in the longitudinal direction of the annular combustor of this invention and illustrating the details of this invention.
Figure 3:
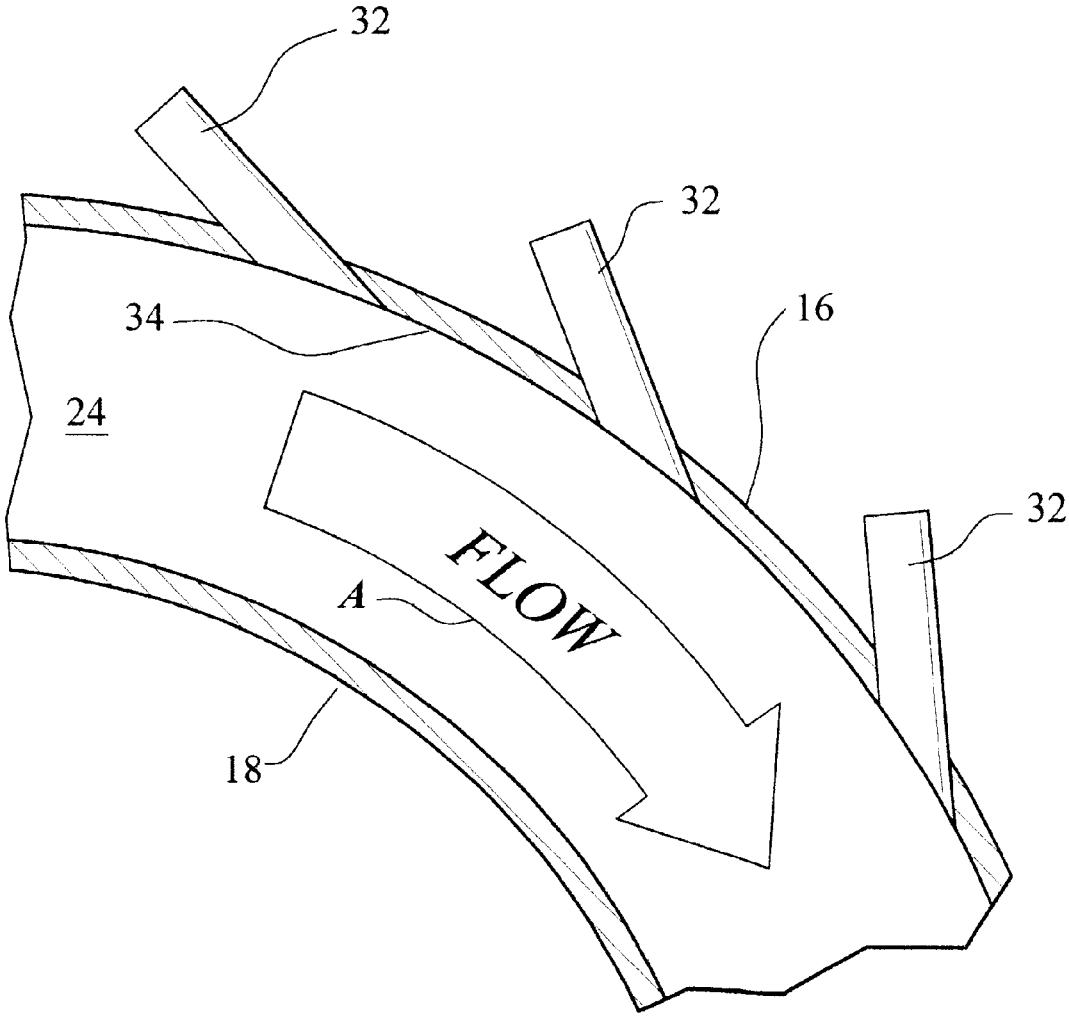
FIG. 3 is a fragmentary sectional view of this invention taken along lines 3—3 of this invention.

These figures merely serve to further clarify and illustrate the present invention and are not intended to limit the scope thereof

DETAILED DESCRIPTION OF THE INVENTION

As indicated in the above paragraphs, this invention serves to reduce the emissions of $NO_X$ from a the combustion chamber of a microturbine engine and is particularly efficacious for a combustion chamber of the type that utilizes a dam between the primary and secondary combustion zones. As best seen in all the Figs. the combustor is an annular combustor generally illustrated by reference numeral 10 and includes a dam 12 that extends inwardly toward the combustion chamber 14. The dam 12 includes the fore disk 13 and aft disk 15, axially spaced from each other that extends inwardly into the combustion chamber 14 from the outer combustion liner wall 16 and the inner combustion liner wall 18 and may include a plurality of circumferentially spaced vanes 20 mounted between the fore disk 13 and aft disk 15, permitting the flow of air into the combustion chamber 14 from the exterior of the outer and inner combustion liner walls 16 and 18, respectively.

The dam 12 divides the combustion chamber into the primary combustion zone 22 and secondary combustion zone 24. Suitable and well known fuel nozzles 26 which include a central fuel injector and air openings are circumferentially spaced around the outer combustion liner 16 and serve to create a recirculation zone for the continuous combustion of the fuel. The products of combustion are accelerated to flow rearward toward the discharge end 30 of the combustor where it is fed into the turbine (not shown) of the microturbine engine. What has been described is the heretofore known combustor of the microturbine engine of the type that is manufactured by the assignee of this patent application and for more details reference should be made to this engine which is incorporated herein by reference.

In accordance with this invention, a plurality of air tubes 32 are circumferentially spaced about the outer combustion liner 16 and terminate at the boundary layer of the combustion products or the inner surface 34 of the combustion liner 16. While this is the preferred configuration, the invention contemplates the end of the air tubes extending into the combustion zone. Of importance, however, is the orientation of the air tubes 32 such that the tubes are at an angle with respect to the combustion liner so that the injected air is in tangential direction so to the create a swirling motion of the air discharging therefrom. From the foregoing it is apparent that the swirling motion of the air injected into the combustion zone is in a plane that is normal to the center line of the annular combustor 10 as shown by the arrow A. Also, in accordance with this invention, the length of tube 32 must be at least 1.5 times the diameter of the internal passage of the tube 32. This will assure that the swirling motion will be created. It is also critical that the air tubes are mounted just downstream of dam 12. It will be appreciated that the air tubes are incorporated for the purpose of creating a swirling zone adjacent the downstream end of dam 12 and are not for admitting dilution air which is the function of the air holes 36.

Although this invention has been shown and described with respect to detailed embodiments thereof, it will be appreciated and understood by those skilled in the art that various changes in form and detail thereof may be made without departing from the spirit and scope of the claimed invention.

What is claimed is:

1. Apparatus for reducing the emissions of $NO_x$ from an annular combustor of a microturbine engine, said annular combustor including an annular combustion liner having a substantially cylindrical outer liner portion and an inner liner portion for defining a primary combustion zone and a secondary combustion zone, a dam attached to said annular combustion liner extending from said outer liner portion and said inner liner portion into the combustion zone of said annular combustor at a juncture between said primary combustion zone and said secondary combustion zone, a plurality of circumferentially spaced a radially outermost portion of air tubes mounted in said outer liner portion for leading only air into said combustion zone immediately downstream of said dam, wherein NOx is reduced.

2. Apparatus for reducing the emissions of $NO_x$ from an annular combustor of a microturbine engine as claimed in claim 1 wherein said tubes are oriented to admit air into said combustion zone in a tangential direction so as to create a swirling motion that is in a plane normal to the center line of the annular combustor.

3. Apparatus for reducing the emissions of $NO_x$ from an annular combustor of a microturbine engine as claimed in claim 2 wherein the length of said air tubes is at least equal to one and a half times the diameter of the passage of said air tubes.

4. Apparatus for reducing the emissions of $NO_x$ from the annular combustor of a microturbine engine as claimed in claim 3 wherein said dam includes an opening into said combustion zone for leading air therein.

5. Apparatus for reducing the emissions of $NO_x$ from an annular combustor of a microturbine engine as claimed in claim 4 including a plurality of vanes circumferentially spaced in said dam.

6. Apparatus for reducing the emissions of $NO_x$ from an annular combustor of a microturbine engine as claimed in claim 5 wherein said outer combustion liner includes an inner surface and the ends of said air tubes are mounted flush with said inner surface.

* * * * *